United States Patent [19]

Rigotti

[11] 4,358,209

[45] Nov. 9, 1982

[54] PRINT RIBBON DRIVING MECHANISM

[75] Inventor: James M. Rigotti, Rochester, Minn.

[73] Assignee: International Business Machines Corporation, Armonk, N.Y.

[21] Appl. No.: 235,782

[22] Filed: Feb. 19, 1981

Related U.S. Application Data

[63] Continuation of Ser. No. 79,607, Sep. 27, 1979, abandoned.

[51] Int. Cl.[3] ..... B41J 33/50; B41J 33/514

[52] U.S. Cl. ..... 400/219.2; 400/229; 400/220.1; 400/220.2

[58] Field of Search ..... 400/220, 220.1, 229, 400/219, 219.2, 219.4, 220.2

[56] References Cited

U.S. PATENT DOCUMENTS

| | | | |
|---|---|---|---|
| 578,919 | 3/1897 | Felt | 400/219.2 |
| 633,827 | 9/1899 | Fox et al. | 400/219.4 |
| 2,304,216 | 12/1942 | Thompson | 400/219.2 |
| 2,742,132 | 4/1956 | Anderson | 400/219.2 |
| 3,174,611 | 3/1965 | Lapointe | 400/229 |
| 3,542,183 | 11/1970 | Stiffler | 400/229 |
| 3,554,349 | 1/1971 | Hebert | 400/219.2 |
| 3,880,271 | 4/1975 | Hebron | 400/220.1 |
| 3,882,989 | 5/1975 | Morelli | 400/229 |
| 3,899,065 | 8/1975 | Brignole | 400/219.2 |
| 4,046,246 | 9/1977 | Kondur, Jr. | 400/220.1 |
| 4,260,271 | 4/1981 | Kondur, Jr. | 400/220.1 |

FOREIGN PATENT DOCUMENTS

| | | | |
|---|---|---|---|
| 2349507 | 4/1974 | Fed. Rep. of Germany | 400/229 |
| 331034 | 10/1935 | Italy | 400/220.1 |

OTHER PUBLICATIONS

Schaefer, "*Ribbon Feed Mechanism*", IBM Technical Disclosure Bulletin, vol. 5, No. 12, pp. 17–18, 5/63.

Field et al., "Fabric Ribbon Mechanism", IBM Technical Disclosure Bulletin, vol. 21, No. 9, pp. 3687–3688, 2/79.

*Primary Examiner*—William Pieprz

*Attorney, Agent, or Firm*—Keith T. Bleuer; Carl W. Laumann, Jr.

[57] ABSTRACT

A print ribbon driving mechanism including a switching bail swingingly mounted on a reciprocatively mounted support movable between two opposite spindles carrying print ribbon spools. The spindles have ratchet teeth, and the switching bail has a pair of opposite pawl surfaces for engaging the ratchet teeth as the support and bail are moved in opposite directions. A trigger lever is provided on each of the spindles which is responsive to the existence of ribbon on the associated spools so that the trigger lever drops into an operative position on depletion of the ribbon from the associated spool, and the switching bail is provided with two opposite camming surfaces adapted to engage the trigger levers in their operative dropped positions for swinging the switching bail into a position to engage the ratchet teeth of the spindle of the dropped trigger lever so as to wind ribbon onto this particular spool.

5 Claims, 4 Drawing Figures

PRINT RIBBON DRIVING MECHANISM

This is a continuation of application Ser. No. 79,607 filed Sept. 27, 1979 and now abandoned.

BACKGROUND OF THE INVENTION

The invention relates to mechanism for driving a print ribbon for a printing machine effective for alternately winding a print ribbon applied across the print head of the machine alternately on one spool at one side in the machine and on an opposite spool at the other side of the machine.

Print ribbon driving mechanisms for alternately winding a print ribbon on opposite spools have been previously proposed which rely on the tension or resistance to further turning of a spool when unwound such as to cause a swing lever to be effective for winding the ribbon on an immediately depleted ribbon spool. An example of such a ribbon drive construction is disclosed in Nicholas Kondur, Jr., U.S. Pat. No. 4,046,246 which discloses a swingable drive arm that is alternately effective for winding a print ribbon on one or the other of a pair of ribbon spools. Another example of such a ribbon drive construction is disclosed in Terrance J. Hebron, U.S. Pat. No. 3,880,271. The Hebron structure includes a swingable feed pawl beam which has two detented positions for this purpose in which its two notches alternately rest on a drive stud. The beam thus has two principal positions in each of which it drives one of a pair of ribbon spools. The International Business Machines Technical Disclosure Bulletin publication, Vol. 21, No. 9, February 1979, pages 3687 and 3688, discloses another example of such a structure. In this structure, a longitudinally movable shifting pawl is alternately effective to drive one or the other of two ribbon spool ratchets, and the mechanism is changed from a condition driving one of the ratchets to a condition driving the other ratchet by a shifter control which is responsive to the amount of ribbon on one of the spools. The shifter control drops when the ribbon is depleted on this spool to drive a detent bar from one position to another position to cause the shifting pawl to be changed in its operation to drive one of the ratchet wheels in lieu of the other.

In Morelli, U.S. Pat. No. 3,882,989, the ribbon advance and reversal mechanism is interconnected to the existing mechanism for raising the ribbon. Accordingly, the ribbon advance occurs during each character print cycle. During each character print cycle the stretch of ribbon intermediate the spools is drawn taut as the winding spool is advanced by the associated indexing pawl and a corresponding length of ribbon is unwound from the opposite spool. This mode of operation may be quite acceptable in the environment wherein printing is effected using a type ball or character printer, as shown. However, in a wire matrix printer the print operation drives the print wire causing the ribbon to billow into contact with the media. If the ribbon is tightly constrained over the print head, the print wires may be impeded in their movements toward the media and/or during retraction which not only interferes with the print operation, but is also likely to damage both the ribbon and the print wires. It is important that any action that causes tensioning of the ribbon occur during a non-print portion of the printer operating cycle.

SUMMARY OF THE INVENTION

It is an object of the present invention to provide an improved ribbon drive mechanism which avoids certain operating problems resulting from the use of ribbon tension for causing ribbon reversal by being responsive only to the substantial absence of ribbon on one of two opposite ribbon spools without influence of ribbon tension to alternate the drive of the two spools so that a just depleted ribbon spool is driven in a ribbon winding direction.

It is a more specific object of the invention to provide such an improved ribbon drive mechanism which includes a swingable switching bail carried by a reciprocative support also carrying a printhead, with the construction being such that the switching bail is swung from one principal position to another principal position under the control of a device responsive to the lack of ribbon on a ribbon spool and by a reciprocation of the support in order to then drive a spindle carrying a depleted ribbon spool in a ribbon winding direction.

In a preferred form, the invention includes such a reciprocative support carrying a printhead with a switching bail swingably mounted on the support. Two spindles each carrying one of two print ribbon spools are provided with ratchet teeth, and the swingable switching bail is provided with pawl surfaces for engaging the ratchet teeth so as to rotate the spindles and cause the associated ribbon spools to rotate in a ribbon winding direction when the support and printhead are moved toward the spindle given such a ribbon winding rotation. Each of the spindles carries a trigger lever which is responsive to the ribbon wound on to the associated ribbon spool so that, when the ribbon is nearly depleted from the spool, the trigger lever fails and engages with a fixed abutment which holds the spindle and the associated spool from further rotation in a ribbon unwinding direction. This is an operative position of the trigger lever, and the swinging bail is provided with opposite cam surfaces which contact the trigger levers of the two spindles when in their operative positions for swinging the bail so that it has the associated pawl surface in position for engaging the ratchet teeth on the spindle of the ribbon depleted spool for then causing the spindle to rotate the ribbon spool in the ribbon winding direction.

It is important that both the ribbon advance effected by the pawl and the ribbon reversal resulting from engagement of the switching bail occur prior or subsequent to a print line when no print operation occurs.

Thus, although it appears that prior art devices such as above U.S. Pat. No. 3,882,989 and the instant invention are similar in that similar empty spool sensing mechanisms are used and both utilize an existing mechanical motion to drive both the ribbon advance and the ribbon reverse, there is a significant difference in the mode of operation and result. This difference results in the applicant's device being useful in the wire printer environment while the prior art devices are at best marginal and at worst wholly unadaptable to such a device. The differences in structure and mode of operation as described may appear to be modest and insignificant, but in practice in the wire printing environment such departures between the prior art and the device of the instant invention are crucial. The structure that causes ribbon advance and reversal during the non-print portion of the printhead movement prevents ribbon damage caused by the print wire actuation against a taut ribbon and print wire malfunction, jamming or damage that may occur under such conditions.

DESCRIPTION OF THE PREFERRED EMBODIMENT

Figure 1:
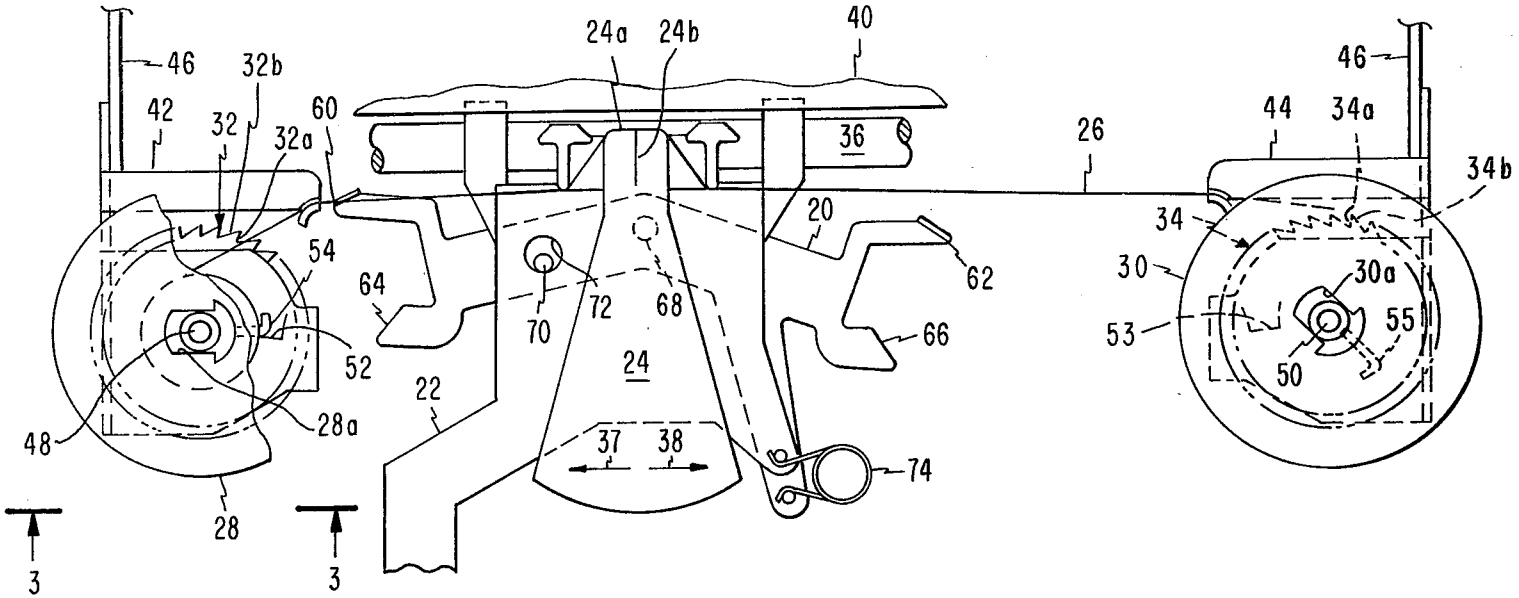
FIG. 1 is a plan view of a print ribbon driving mechanism incorporating the principles of the invention and including a pair of ribbon spool carrying spindles, a trigger lever swingably mounted on each of the spindles and a switching bail swingably mounted on a reciprocative support carrying a printhead.

The print ribbon driving mechanism includes a switching bail 20 which is oscillatably disposed on the carrier 22 for a printhead 24 of a printing machine. The printhead 24 has a nose tip 24*a*, and a print ribbon 26 passes over the nose tip 24*a*. The ribbon 26 is disposed on ribbon supply spools 28 and 30 and has its ends fixed to the spools. The spools 28 and 30 are disposed on the toothed spindles 32 and 34 respectively. The teeth on the spindle 32 have radially extending surfaces 32*a* and alternate surfaces 32*b* connecting the surfaces 32*a* and extending at an angle with respect to radial. The teeth on the spindle 34 have radially extending tooth surfaces 34*a* connected by alternate tooth surfaces 34*b* connecting the tooth surfaces 34*a* and extending at an angle with respect to radial. As the teeth are seen in plan in FIG. 1, it will be noted that the tooth surfaces 32*b* and 34*b* slant inwardly toward the centers of the spindles oppositely with respect to each other, and this is so that the radially extending tooth surfaces 32*a* and 34*a* are available for engagement by the bail 20 approaching the spindles 32 and 34 from opposite directions as will be apparent from subsequent description.

The carrier 22 is slideably disposed on a stationary carrier guide rod 36 so that the carrier 22 and thereby the printhead 24 may reciprocate in directions 37 and 38. The printhead 24 may thus provide lines of print on the printing medium 40 with the lines of print extending in directions 37 and 38. The printhead 24 for this purpose may be of the wire type which includes wires 24*b* that are selectively thrust through the nose tip 24*a* to billow the ribbon 26 off the tip 24*a* and into contact with the medium 40 for printing corresponding dots on the medium 40. The carrier 22 is reciprocatively driven in directions 37 and 38 by any suitable motive means (not shown).

Figure 2:
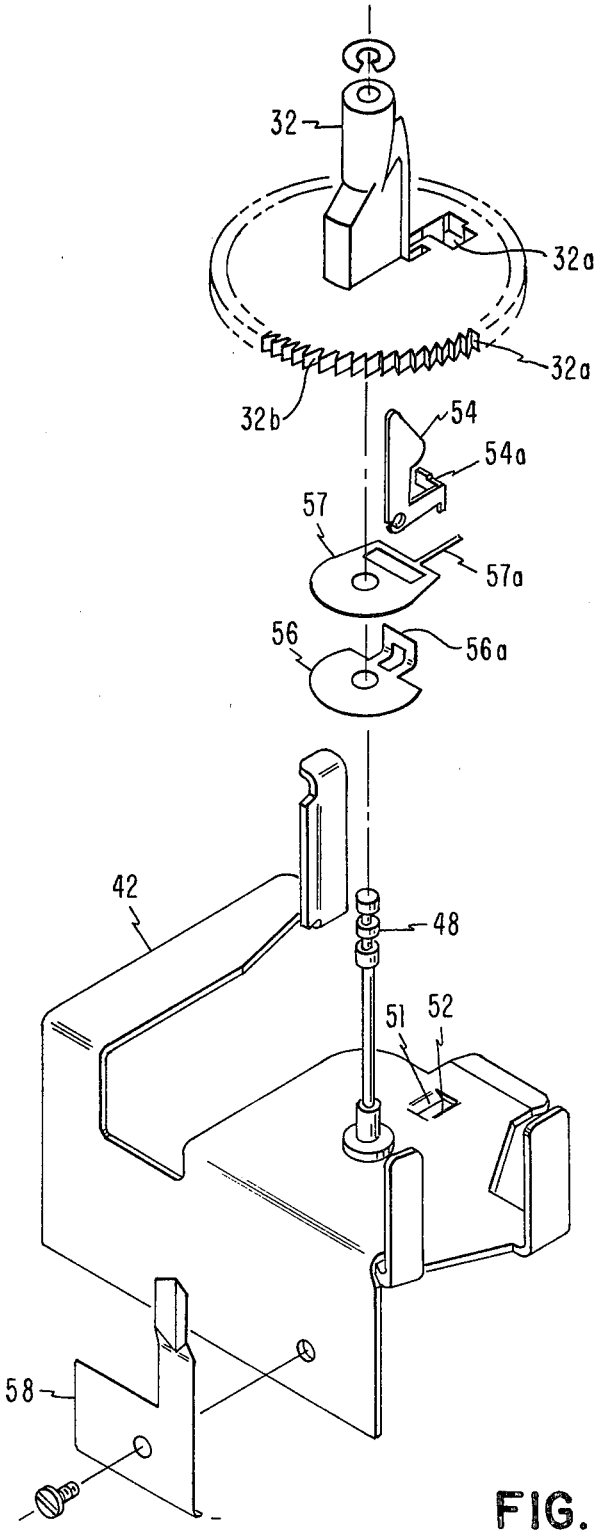
FIG. 2 is an exploded view of one of the spindles together with the trigger lever swingably mounted on the spindle.
Figure 4:
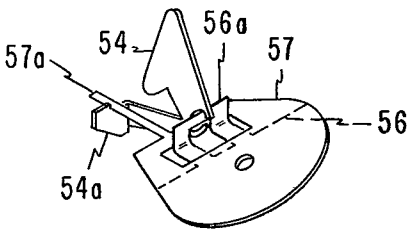
FIG. 4 is a fragmentary view of one of the trigger levers together with its support.
Figure 3:
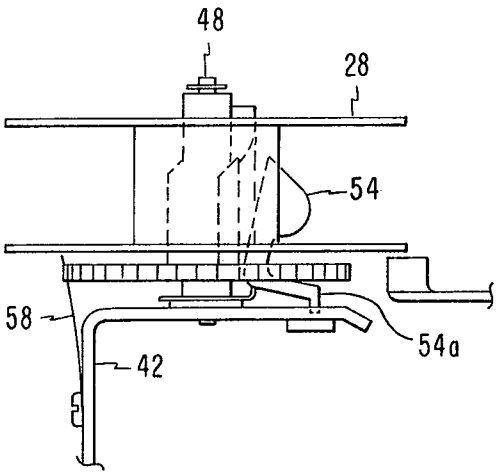
FIG. 3 is a side elevational view of one of the spindles together with its trigger lever and taken from lines 3—3 of FIG. 1.

Spool brackets 42 and 44 are mounted to the frame 46 of the machine in which the printhead 24 is installed, and brackets 42 and 44 respectively carry the spindle studs 48 and 50. The spool bracket 42 having the spindle stud 48 mounted thereon is shown in detail in FIG. 2, and the assembly of the spindle stud 50 on the spool bracket 44 is similar. The upper surface of the bracket 42 is embossed with a depression 51 providing a vertical shoulder 52, and a similar shoulder 53 is formed on the bracket 44. Spindles 32 and 34 have reversing trigger levers 54 and 55 swingably mounted on them. The levers 54 and 55 and their mountings on the tooth spindles 32 and 34 are similar, and the lever 54 together with its mounting is shown in detail in FIGS. 2, 3 and 4. The lever 54 is swingably mounted on the upstanding portion 56*a* of a bracket 56 fitting over stud 48 and extends upwardly through an opening 32*a* in spindle 32. The lever 54 has a toe portion 54*a*, and the tang 57*a* of a leaf spring 57 fitting over bracket 56 extends over the toe portion 54*a* for the purpose of providing a swinging force on the lever 54 tending to swing the lever 54 away from the center line of the spindle 32 and stud 48 and urging the lever downwardly into engagement with the upper surface of the bracket 42. A drag spring 58 is attached to the bracket 42 and engages with the teeth of the associated spindle 32, and a similar drag spring (not shown) is used in connection with the spindle 34. Each of the spindles 32 and 34 is provided with a non-round exterior surface, and this surface corresponds with and mates with a corresponding non-round opening 28*a* in the spool 28 or 30*a* in the spool 30.

The bail 20 is provided with pawl surfaces 60 and 62 on opposite ends and with camming surfaces 64 and 66 on opposite ends. The bail 20 is swingably disposed on the carrier 22 by means of a pin 68, and a pin 70 extends through an opening 72 in the bail 20 for limiting the swinging movement of the bail 20. An overcenter spring 74 is provided effectively between the bail 20 and the carrier 22 for yieldably holding the bail 20 in either of its end positions limited by the pin 70.

In operation, the carrier 22 and the printhead 24 are reciprocated in the opposite directions 37 and 38 so that the head 24 may print lines of print on the print medium 40. Initially, the bail 20 may be assumed to be in its position shown in FIG. 1, swung in the clockwise direction about the pin 68 to a limit determined by the pin 70. When the head 24 along with the carrier 22 moves in the direction 38 to complete a line of print on the medium 40 in this direction, the pawl surface 62 moves into engagement with one of the tooth surfaces 34*a* on the spindle 34 and thus rotates the spindle 34 about the spindle axis in the clockwise direction as seen in FIG. 1 for a certain arc, for example corresponding to four of the teeth on the spindle 34. The spool 30 has a non-rotative connection with the spindle 34, and the spool 30 thus rotates for the same arc of rotation. The ribbon 26 is fixed at its ends to the spools 28 and 30, and this rotation of the spool 30 thus winds the ribbon 26 onto the spool 30 and unwinds the ribbon from the spool 28 which rotates correspondingly and freely in the clockwise direction (see FIG. 1) about the axis of the spindle 32. The carrier 22 and printhead 24 then reciprocate in the opposite direction 37 for printing a line of print in this direction; however, with the bail 20 being in its illustrated position of FIG. 1 with respect to the carrier 22, the pawl surface 60 is out of line with respect to and passes over and makes no contact with the teeth of the spindle 32. The spindle 32 and the spool 28 are thus not rotated with this reciprocation of the printhead 24 and carrier 22 in direction 37. Each successive reciprocation of the printhead 24 and bail 20 in the direction 38 winds a corresponding length of the ribbon 26 onto the spool 30, while the corresponding reciprocations in the direction 37 have no effect on the spindle 32 and spool 28.

When the ribbon 26 is depleted on the spool 28 until practically none of the ribbon remains on the spool 28, the trigger lever 54 is no longer held by the ribbon 26 on the spool 28 in the position of the lever 54 in which its lower end 54*a* is out of contact with the upper surface of the bracket 42. The lever 54 thus swings downwardly due to the action of the spring tang 57*a*, since the lever 54 is no longer held by the ribbon 26; and the lower end 54*a* of the lever 54 makes contact and rides on the upper surface of the bracket 42. On a final arc of rotation of the spindle 32 and spool 28 (in the ribbon unwinding clockwise direction as seen in FIG. 1), the lever end 54*a* moves downwardly into the depression 51 and strikes the shoulder 52 which prevents any further rotation of the spindle 32 and spool 28 about the axis of the spindle 32 in the clockwise direction as seen in FIG. 1. On the next succeeding reciprocation of the carrier 22 and bail 20 in the direction 37, the camming surface 64 strikes the lower end 54*a* of the trigger lever 54 in contact with the shoulder 52, and the bail 20 is thus swung in the counterclockwise direction about the pin 68 to the limit of its movement in this direction as limited by the pin 70. On subsequent movements of the carrier 22 and head 24 in the direction 37, the pawl surface 60 is then in place to strike a tooth surface 32*a* of the spindle 32, and the spindle 32 and the spool 28 are thus rotated in the counterclockise direction as seen in FIG. 1 in order to wind the ribbon 26 onto the spool 28 with a corresponding unwinding of the ribbon 26 from the spool 30. The pawl surface 62, with the bail 20 being at the limit of its rotation in the counterclockwise direction as seen in FIG. 1, is out of line for engaging with the teeth of the spindle 34, and the spindle 34 and spool 30 thus have a free ribbon unwinding action. The lever 54 is swung upwardly out of engagement with the upper surface of the bracket 42 by the ribbon 26 as it winds on the spool 28.

Finally the ribbon will be depleted from the spool 30, and the trigger lever 55 will swing downwardly and engage the abutment surface 53 so as to hold the spool 30 and spindle 34 from any further unwinding action; and the cam surface 66 will strike the trigger lever 55 in contact with the shoulder 53 and will again swing the bail 20 back into its illustrated position in which the pawl surface 62 is effective on the teeth of the spindle 34 as above described.

These reciprocations of the bail 20 to the limits of its swinging movement by the actions of the camming surfaces 64 and 66 on the trigger levers 54 and 55 respectively as the ribbon 26 is depleted from one or the other of the spools 28 and 30 cause the ribbon 26 to be successively and alternately wound on the spools 30 and 28 from the other of the spools.

The ribbon drive mechanism of the invention has numerous advantages. It is not dependent on the tension of the ribbon 26 for reversing the spooling actions of the spools 28 and 30 so that it is not subject to a potential blockage of ribbon movement for one reason or another which could cause an undesirable premature reversal of ribbon movement prior to an exhaustion of either one of the ribbon spools and so that the print wires 24*b* cannot be impeded in their movements toward the medium 40 by the ribbon 26 and possibly punch through the ribbon 26 and be prevented by the ribbon from full return movement with a disastrous ribbon and wire jam resulting. The ribbon drive mechanism of the invention does not require the use of sensing arms dragging on the ribbon 26 during spooling to change the winding direction which could cause undesired ribbon tension and which would have to be rotated out of the way manually when a new ribbon is installed in the machine. The ribbon loading path is simple particularly since the ribbon is not routed around such tension arms. The ribbon drive has few parts resulting in a very low cost mechanism; it does not exert a drag on the carrier 22 for the printhead 24 during printing; the tension on the ribbon 26 is not increased during reversing; and the swingable bail 20 together with the carrier 22 and printhead 24 as an assembly has a desirably low inertia.

Having thus described my invention, what I claim as new, and desire to secure by Letters Patent is:

1. Mechanism for driving a pair of spools having a print ribbon wound thereon and extending therebetween and including:

a pair of rotatably mounted, fixedly positioned spindles each adapted to carry a print ribbon spool, a reciprocatively mounted support carrying a printhead which is movable between said spindles, toward one of said pair of spindles and away from the other of said spindles, a switching bail swingably mounted on said reciprocatively mounted support and having two pawl portions on opposite ends formed as an integral part of said bail, one of which is adapted to contact and rotate one of said spindles during the final portion of reciprocative motion of said support toward said one spindle in the first principal swung position of the switching bail, and the other of which is adapted to contact and rotate the other of said spindles during the final portion of reciprocative motion of said support toward such other spindle in the second principal swung position of the switching bail, a trigger lever swingably mounted on each of said spindles and adapted to swing into an operative position as the last convolution of ribbon is unwound from the spool mounted on this spindle, and a pair of camming surfaces on opposite ends of said switching bail for engaing the associated one of said trigger levers in the said operative position as said support moves toward the spindle carrying said one trigger lever so that the switching bail is swung from one principal swung position to the other principal swung position to be effective to drivingly rotate said spindle carrying said one trigger lever on successive reciprocative movements of said support toward this spindle for thereby causing the spool on such spindle to wind the print ribbon thereon;

said switching bail in one principal swung position engaging one spindle with said pawl portion at one end of a reciprocative stroke and having the camming surface at the opposite end of the bail positioned to contact the trigger lever of the other spindle, when in said operative position, at the end of the opposite reciprocative stroke to pivot said switching bail to the other of said principal swung positions, whereby during a reversing action said pawl portions are disengaged from said spindles.

2. Mechanism for driving a pair of spools as set forth in claim 1 and including fixed abutment means contacted by each of said trigger levers to limit the rotative movement of the spindle on which the trigger lever is mounted in the ribbon unwinding direction and to define said operative position of the trigger lever.

3. Mechanism for driving a pair of spools as set forth in claim 1 and including an overcenter spring for yieldably holding said switching bail in either of its said two principal swung positions.

4. Mechanism for driving a pair of spools as set forth in claim 1, each of said spindles having ratchet teeth with radially extending tooth portions adapted to be engaged by a said pawl portion of the switching bail as it moves toward this particular spindle for rotatably driving this spindle in a ribbon winding direction.

5. Printing mechanism including:

a pair of rotatably mounted, fixedly positioned spindles each adapted to carry a print ribbon spool, a support reciprocatively mounted between said spindles which moves toward one of said pair of spindles and away from the other of said pair of spindles and during reciprocation in at least one direction has a print cycle portion preceded by and succeeded by non-print cycle portions, a printhead of the projectable wire type carried by said support about which the ribbon carried by said spools may pass so that the printhead is effective to print with its said wires projecting against the ribbon, spindle driving means carried by said support and switchable in its action for driving one of said spindles or the other of said spindles as said support moves toward the respective spindle during the final non-print cycle portion of its reciprocative movement in one direction, a trigger lever swingably mounted on each of said spindles and responsive to the existence or lack of ribbon on the spool carried by the particular spindle so that the trigger lever is swung into an operative position when the ribbon is depleted on the spool mounted on the particular spindle, and means carried by said spindle driving means and responsive to contact with the trigger lever on the spindle associated with the spool being unwound, when the lever is in its said operative position during a non-print cycle portion, for switching said driving means to drive the spindle carrying the trigger lever which is in its said operative position.

* * * * *